US010226682B2

(12) United States Patent
Mulholland et al.

(10) Patent No.: US 10,226,682 B2
(45) Date of Patent: Mar. 12, 2019

(54) BALL SAFETY NETTING SYSTEMS HAVING GATE ACCESS/EGRESS

(71) Applicant: SPORTSFIELD INTELLECTUAL, LLC, Delhi, NY (US)

(72) Inventors: Keegan R. Mulholland, East Merideth, NY (US); Joshua A. Hicks, Sherburne, NY (US)

(73) Assignee: SPORTSFIELD INTELLECTUAL, LLC, Delhi, NY (US)

( * ) Notice: Subject to any disclaimer, the term of this patent is extended or adjusted under 35 U.S.C. 154(b) by 90 days.

(21) Appl. No.: 15/208,193

(22) Filed: Jul. 12, 2016

(65) Prior Publication Data

US 2018/0015351 A1 Jan. 18, 2018

(51) Int. Cl.
*A63B 71/02* (2006.01)

(52) U.S. Cl.
CPC ..... *A63B 71/022* (2013.01); *A63B 2209/10* (2013.01); *A63B 2225/09* (2013.01); *A63B 2225/093* (2013.01)

(58) Field of Classification Search
CPC ..... A63B 71/02; A63B 67/00; A63B 63/00; E06B 3/80; E06B 9/52; G09F 17/00
USPC ..... 473/421, 415
See application file for complete search history.

(56) References Cited

U.S. PATENT DOCUMENTS 6,807,999 B1 10/2004 Bowen et al.
6,938,785 B2 9/2005 Denny et al.
9,017,190 B2 4/2015 Hulbert
9,295,900 B1 * 3/2016 Dixon, Jr. ..... A63B 71/022
2002/0098920 A1 * 7/2002 Bruyer ..... A63B 71/022 473/421
2012/0322567 A1 12/2012 Manieri
2014/0141906 A1 * 5/2014 Hulbert ..... A63B 71/022 473/415
2015/0251073 A1 9/2015 Hulbert

OTHER PUBLICATIONS

Paul Hagen, "MLB recommends netting between dugouts" and comments, www.mlb.com, printout available online on Jan. 11, 2018, at https://www.mlb.com/news/mlb-issues-recommendations-on-netting/c-159233076, 14 pages, Dec. 9, 2015.
Evan Grant, "Rangers to install additional protective netting on top of dugouts at Globe Life Park for improved fan safety", sportsday.dallasnews.com, printout available online on Jan. 12, 2017, at https://sportsday.dallasnews.com/texas-rangers/rangers/2016/02/18/rangers-install-additional-protective-netting-top-dugouts-globe-life-park-citing-interest-fan-safety, 4 pages, Feb. 18, 2016.
(Continued)

*Primary Examiner* — Gene Kim
*Assistant Examiner* — Christopher Glenn
(74) *Attorney, Agent, or Firm* — Heslin Rothenberg Farley and Mesiti PC

(57) ABSTRACT

A ball safety netting system for use between a field and spectators and above an access/egress gate includes, for example, a main netting defining an opening over an access/egress gate, a gate netting positionable over the opening of the main netting, and wherein the gate netting is disposable in a first position operable to cover the opening in said main netting above the access/egress gate, and disposable in a second position operable to uncover the opening above the access/egress gate.

36 Claims, 9 Drawing Sheets

(56) References Cited

OTHER PUBLICATIONS

Rustin Dodd, "Royals add more safety netting at Kauffman Stadium", http://www.kansascity.com, printout available online on Nov. 27, 2017, at http://www.kansascity.com/sports/spt-columns-blogs/k-zone/article60830091.html, 6 pages, Feb. 17, 2016.
Mike Berardino, "New dugout netting at Target Field to protect fans", http://www.twincities.com, printout available online on Nov. 27, 2017, at http://www.twincities.com/2016/01/31/minnesota-twins-new-dugout-netting-at-target-field-to-limit-injuries/, 3 pages, Jan. 31, 2016.
Texas Ranger stadium netting system, four images, 4 pages, at least as early as Oct. 11, 2017.
Larson Escape 16-ft×96-in Adobe Garage Retractable Screen Door, manufactured by Larson Manufacturing Company, Inc., printed Jul. 12, 2016, available online at http://www.lowes.com/pd_423160-62847-E8006919296_1z11pp4_?productId=50384162&pl=1, 1 page, at least as early as Jan. 6, 2016.
Larson 36-in×72-in White Retractable Screen Door, manufactured by Larson Manufacturing Company, Inc., printed Jul. 12, 2016, available online at http://www.lowes.com/pd_423146-62847-NV100033672_1z11pp4_?productId=50384134&pl=1, 2 pages, at least as early as Jan. 6, 2016.

* cited by examiner

BALL SAFETY NETTING SYSTEMS HAVING GATE ACCESS/EGRESS

FIELD OF THE DISCLOSURE

The present disclosure relates generally to ball safety netting systems, and more particularly to ball safety netting systems having gate access/egress.

BACKGROUND

Conventional ball safety netting systems offer protection to athletes, coaches, officials, and spectators from balls leaving the field of play.

Some ball safety system nets are held up at the top of a pole by a quick clip, or a quick clip attached to a tether hanging from a pulley to facilitate the raising and lowering of the net. Tension netting systems include hardware that is connected to structural steel poles to which cabling is attached and tensioned for support of the net.

SUMMARY

Shortcomings of the prior art are overcome and additional advantages are provided through the provision, in one embodiment, of a ball safety netting system for use between a field and spectators and above an access/egress gate which includes, for example, a main netting defining an opening over an access/egress gate, a gate netting positionable over the opening of the main netting, and wherein the gate netting is disposable in a first position operable to cover the opening in the main netting above the access/egress gate, and disposable in a second position operable to uncover the opening above the access/egress gate.

In another embodiment, a ball safety netting system for use between a field and spectators and above an access/egress gate is provided. The ball safety netting system includes, for example, a main netting system having edge portions defining an opening over an access/egress gate and a gate netting system positionable over the opening and overlapping the edge portions of the main netting system. The main netting system includes first vertically-extending cables each of which disposable adjacent a different one of a first side and a second side of the access/egress gate, and a main netting operably attached to one of the first vertically-extending cables and operably attached to the other of the first vertically-extending cables. The gate netting system includes second vertically-extending cables each of which disposable adjacent a different one of the first side and the second side of the access/egress gate, and a gate netting operably attached along one edge portion to one of the second vertically-extending cables and along another edge portion to the other of the second vertically-extending cables. The gate netting system is disposable in a first position operable to cover the opening above the access/egress gate, and disposable in a second position operable to uncover the opening above the access/egress gate.

In another embodiment, a method is provided, which includes, for example, providing a main netting along a playing field having a gate, the main netting having an opening disposed above the gate, and providing a gate netting over the opening in the main netting.

In another embodiment, a method is provided, which includes, for example, providing the ball safety netting along a playing field having a gate, disposing the ball safety netting in a first position operable to cover an opening in the ball safety netting above the access/egress gate, and disposing the ball safety netting in a second position operable to uncover the opening above the access/egress gate.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is directed to ball safety netting systems which may protect spectators in the stands from balls leaving the field of play. In addition, the ball safety netting systems of the present disclosure provide gate access/egress for use in entering the stands from the field and exiting the stands to the field. As described in greater detail below, a ball safety netting system may have a movable, repositionable, or retractable portion allowing use of a gate, for example, for permitting access or egress though the gate. For example, the ball safety netting system may have a first or lowered configuration for protection of the spectators and a second or raised configuration which permits access or egress though the gate. In addition, the ball safety netting systems of the present disclosure may be configured to allow generally unobstructed view by the spectators of the field.

Figure 1:
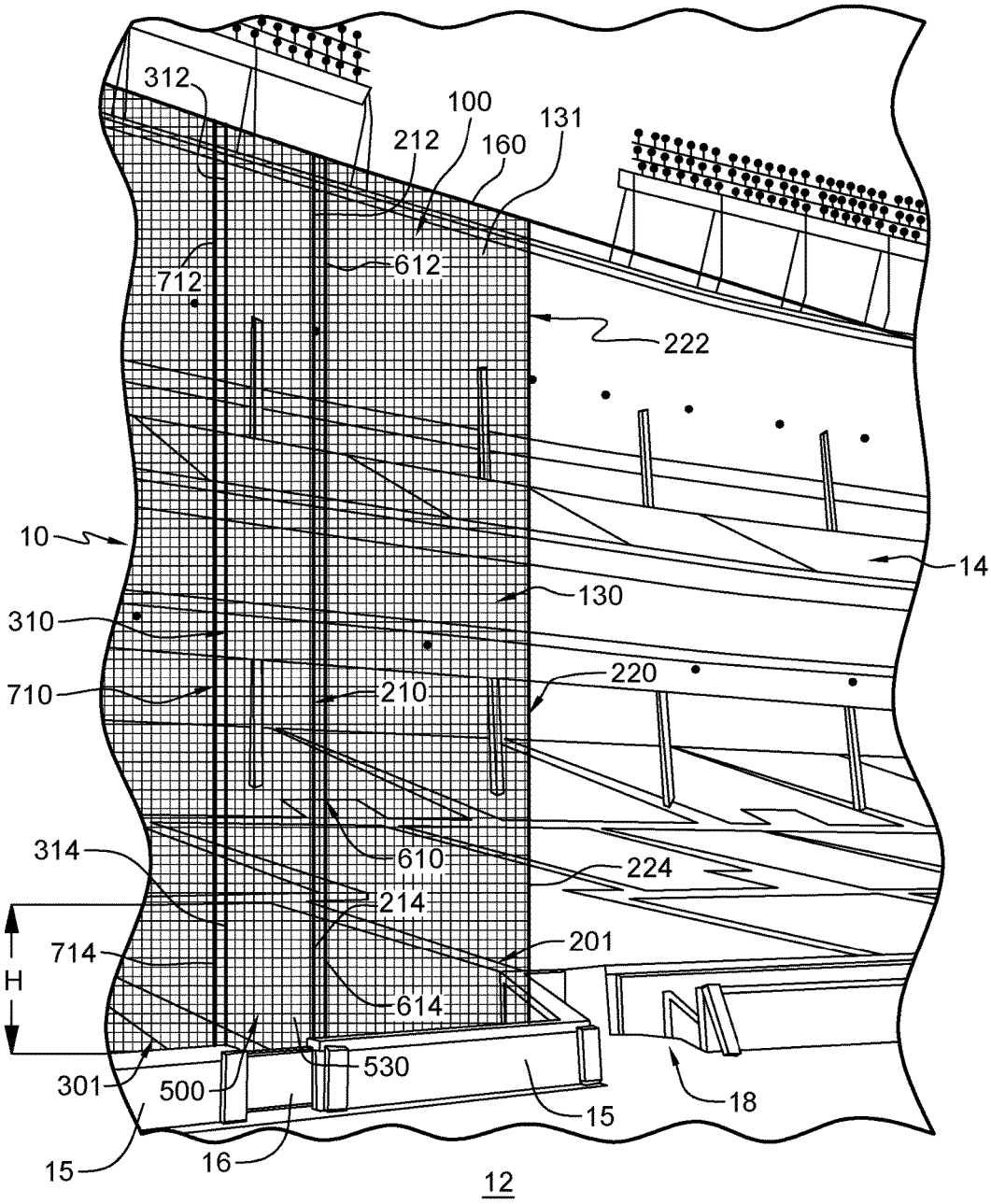
FIG. 1 is a perspective view of a ball safety netting system having gate access/egress according to an embodiment of the present disclosure illustrated disposed between stands and a field.

FIG. 1 illustrates a ball safety netting system 10 having gate access and egress according to an embodiment of the present disclosure. Ball safety netting system 10 may be disposed between a field 12 such as an athletic field and stands 14 having, for example, a plurality of rows of seats surrounding at least a portion of field 12. As will be appreciated from the present description, by providing gate access and egress along the field, the ball safety netting system may be disposed along or span a greater portion or distance between the field and the stands. For example, the ball safety netting system may be disposed further away from, for example home plate, than a conventional ball safely netting system that extends immediately around home plate and that may leave spectators along the baselines at risk from foul balls and broken bats.

Ball safety netting system 10 may generally include a main netting system 100 and a movable, repositionable, or retractable gate netting system 500 disposed above an access/egress gate 16. For example, ball safety netting system 10 may extend around home plate (not shown) and past gate 16 to a beginning of, for example, a dugout 18 for protecting spectators in stands 14. In this embodiment, ball safety netting system 10 may be configured as a protective tension netting systems, which minimizes or eliminates the use of poles by using a cable based system with tie backs to existing concrete or steel structures. In other embodiments, a ball safety netting system according to the present disclosure may operably include poles.

Figure 2:
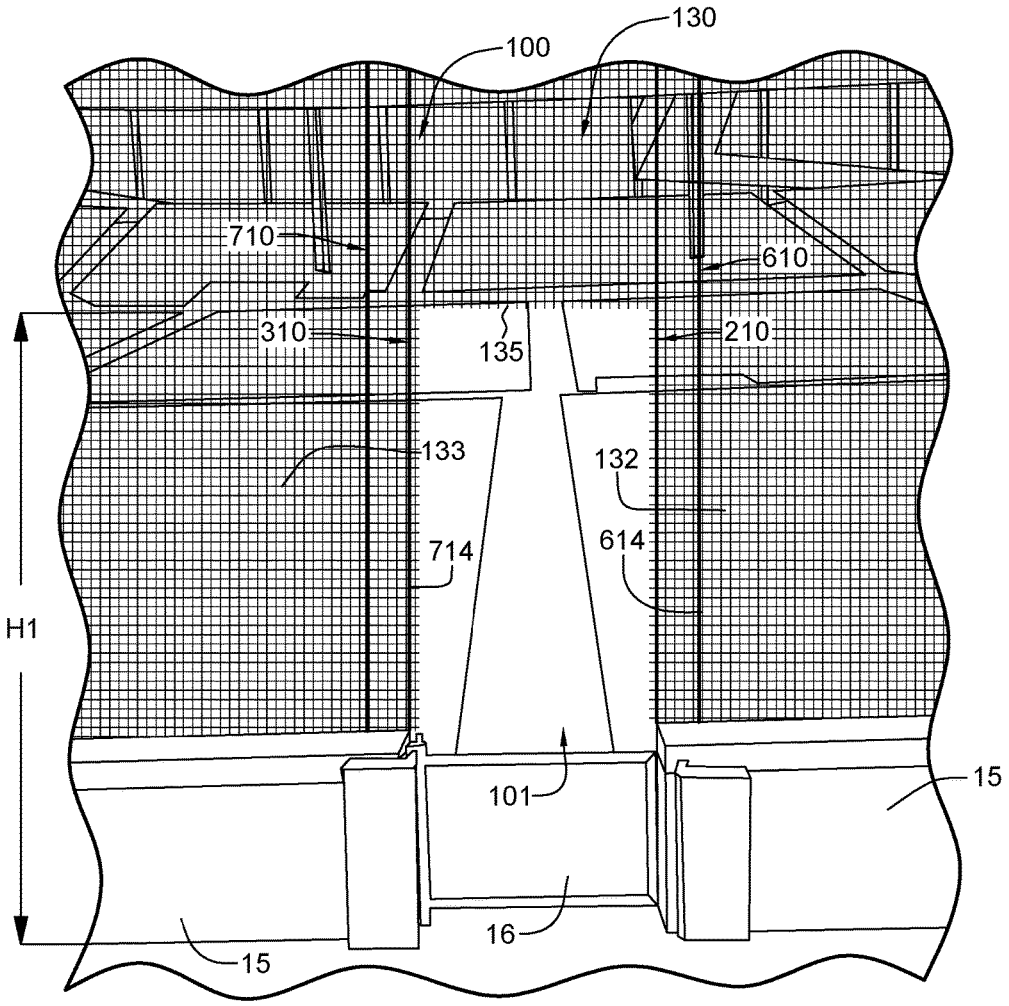
FIG. 2 is an enlarged perspective view of the lower portion of the ball safety netting system of FIG. 1 with the main netting system defining an opening over the gate.
Figure 7:
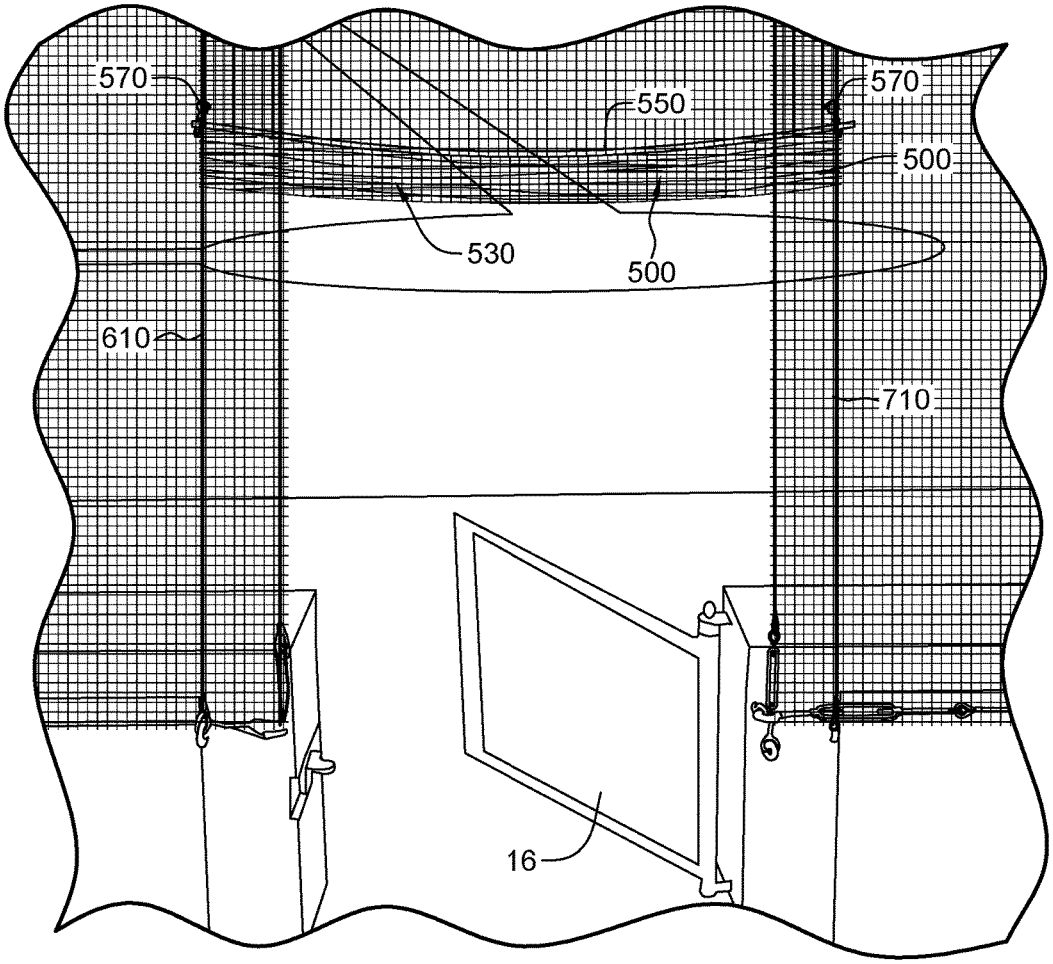
FIG. 7 is an enlarged perspective view of a lower portion of the ball safety netting system of FIG. 1 looking out from the stands onto the field with the gate netting system disposed in a second or raised position allowing access or egress past the gate.

With reference to FIGS. 1 and 2, main netting system 100 may generally define an opening 101 (FIG. 2) disposed over gate 16. For example, main netting system 100 may define an inverted U-shaped netting configuration defining opening 101 (FIG. 2) having a rectangular configuration over gate 16. As described in greater detail below, gate netting system 500 (FIG. 1) is disposable in a first lowered position as shown in FIG. 1 with gate netting system 500 covering opening 101 (FIG. 2), and disposable in a second or raised position as shown in FIG. 7 with opening 101 (FIG. 1) being uncovered above the access/egress gate.

With reference again to FIGS. 1 and 2, in this illustrated embodiment, upper portions of main netting system 100 may be supported generally by an upper generally horizontally-extending cable 160 (FIG. 1). For example, main netting system 100 may include a first vertically-extending cable 210 disposed adjacent a first side of gate 16, and a spaced-apart second vertically-extending cable 220 (FIG. 1) disposed away from gate 16. An upper end 212 (FIG. 1) of first cable 210 and an upper end 222 (FIG. 1) of cable 220 (FIG. 1) may be operably connected to horizontally-extending cable 160 (FIG. 1). A lower end 214 of first cable 210 and a lower end 224 (FIG. 1) of second cable 220 (FIG. 1) may be operably connected to a support structure 15 such as a wall disposed between the field and the stands.

Main netting system 100 may further include a third vertically-extending cable 310 disposed adjacent a second side of gate 16, and a spaced-apart fourth vertically-extending cable (not shown but disposed to the left away from the gate in FIGS. 1 and 2). An upper end 312 (FIG. 1) of third cable 310 and an upper end (not shown) of the fourth cable (not shown) may be operably connected to horizontally-extending cable 160 (FIG. 1). A lower end 314 of third cable 310 and a lower end (not shown) of the fourth cable (not shown) may be operably connected to support structure 15 such as the wall disposed between the field and the stands.

Main netting system 100 may include a main netting 130 having a generally inverted U-shaped configuration. As described in greater detail below, main netting 130 may be operably connected along an upper edge portion 131 (FIG. 1) to horizontally-extending cable 160 (FIG. 1), to vertically extending cables 210, 220, and 310, and to lower horizontally-extending cables (not shown in FIGS. 1 and 2) for example such lower horizontally-extending cables being disposed along the inside of support structure 15 such as the wall disposed between the field and the stands.

As shown in FIG. 2, main netting system 100 defines opening 101 disposed over gate 16. For example, a first vertical edge portion 132 of main netting 130 may be operably spaced apart from a second vertical edge portion 133 of main netting 130. A horizontal edge 135 of main netting 130 may extend between upper portions of first vertical edge portion 132 and second vertical edge portion 133. Horizontal edge 135 of main netting 100 may be disposed a height between about 72 inches to about 100 inches from the field, about 80 inches to about 88 inches from the field, about 84 inches from the field, or other suitable distance from the field.

Figure 3:
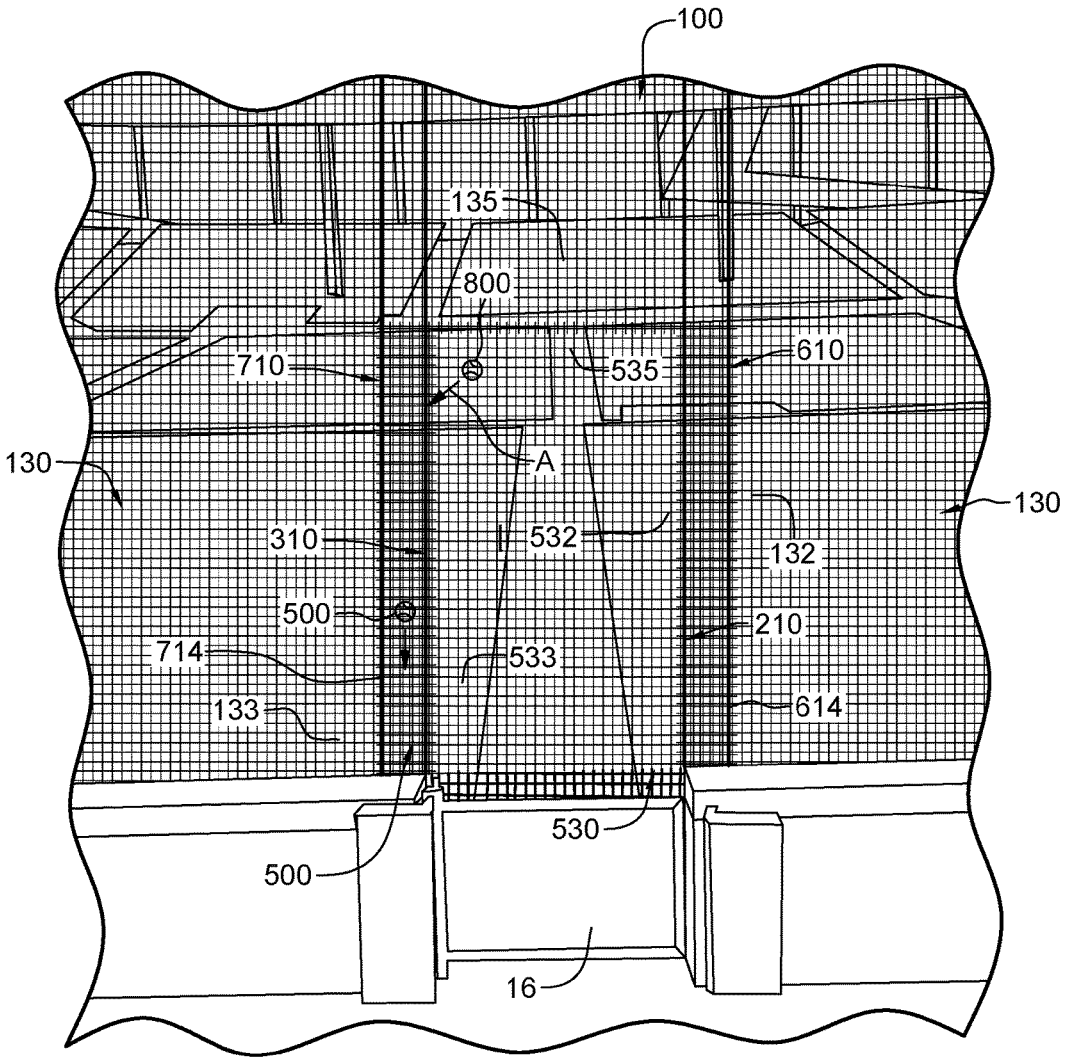
FIG. 3 is an enlarged perspective view of the lower portion of the ball safety netting system of FIG. 1 with the gate netting system disposed in a first or lowered position covering the opening in the main netting system.

With reference to FIGS. 1 and 3, gate netting system 500 may include a first vertically-extending cable 610 disposed adjacent the first side of gate 16, and a spaced-apart second vertically-extending cable 710 disposed adjacent the second side of gate 16. For example, vertical cables 610 and 710 may be spaced outwardly from vertical cables 210 and 310, respectively, of main netting system 100. An upper end 612 (FIG. 1) of cable 610 and an upper end 712 (FIG. 1) of cable 710 may be operably connected to horizontally-extending cable 160 (FIG. 1). A lower end 614 of cable 610 and a lower end 714 of cable 710 may be operably connected to support structure 15 such as the wall disposed between the field and the stands.

Figure 4:
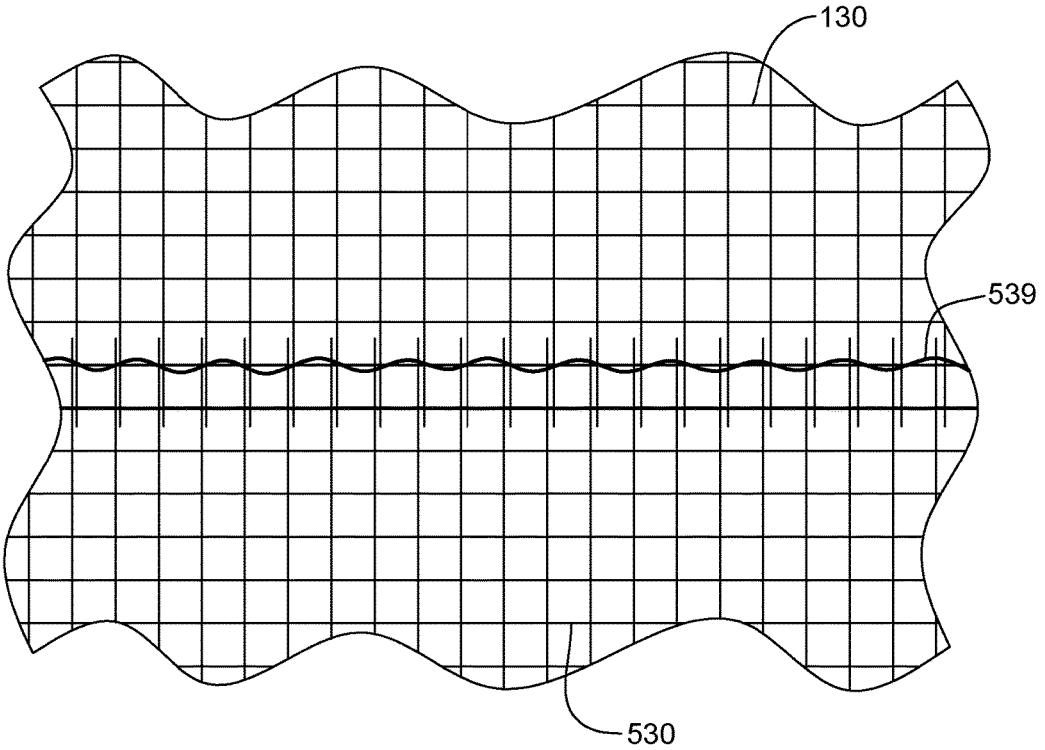
FIG. 4 is an enlarged elevational view of a portion of the attachment between horizontal portions of the main netting and the gate netting of the ball safety netting system of FIG. 1.

Gate netting system 500 may include a gate netting 530 having for example a rectangular configuration that overlaps portions of main netting 130. As described in greater detail below, gate netting 530 may be operably connected along vertically-extending cables 610 and 710, and to horizontal edge of main netting 135. As shown in FIG. 3, gate netting 530 may include a first edge portion 532 supported by cable 610 so that first edge portion 532 of netting 530 overlaps first edge portion 132 of main netting 130. Gate netting 530 may include a second edge portion 533 supported by cable 710 so that second edge portion 533 of netting 530 overlaps second portion 132 of main netting 130. Gate netting 530 may include a upper edge portion 535 that overlaps and is operably attached to horizontal edge 135 of main netting 130 that extends between upper portions of first vertical edge portion 132 and second vertical edge portion 133. For example, as shown in FIG. 4, a lower row of main netting 130 may be sewn to an upper row of gate netting 530. For example, a twine or thick thread 539 may be woven in and out of the nettings to secure the horizontal edge of the gate netting to the horizontal edge of main netting. A suitable twine may be a 1.9 millimeters in diameter DYNEEMA rope.

Figure 5:
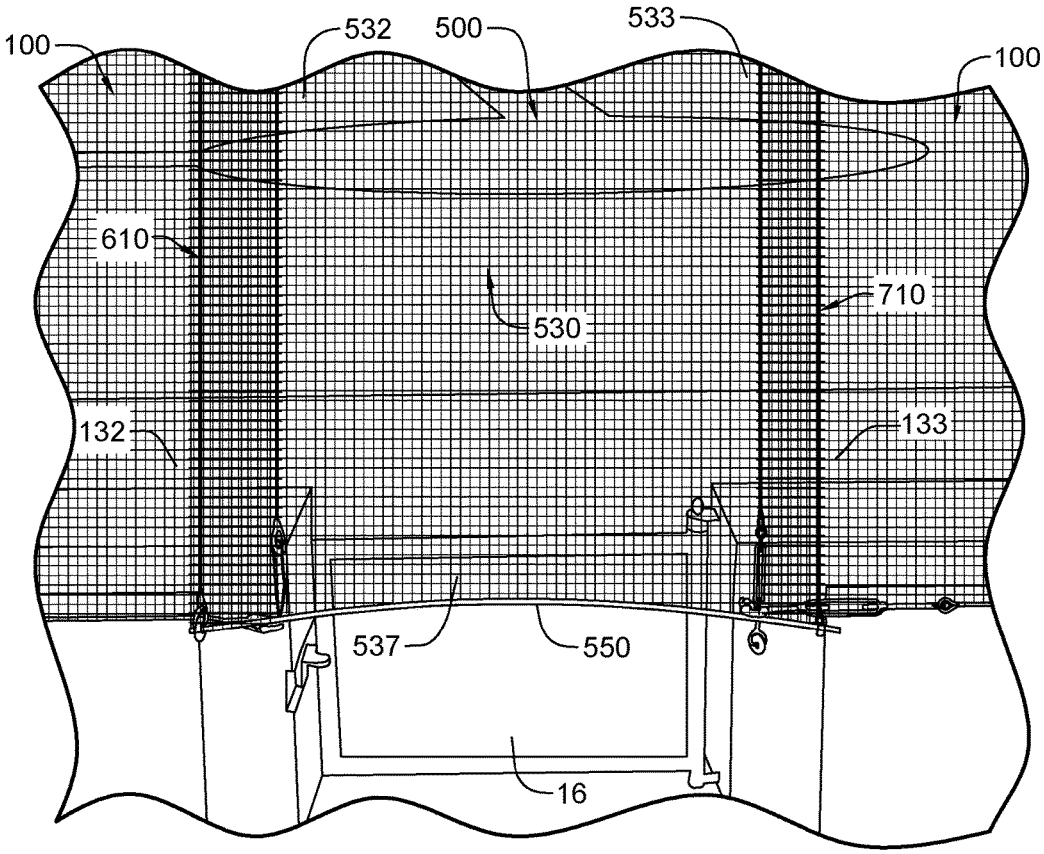
FIG. 5 is an enlarged perspective view of the lower portion of the ball safety netting system of FIG. 3 looking out from the stands onto the field with the gate netting system disposed in the first or lowered position covering the opening in the main netting system.

With reference to FIG. 5, gate netting system 500 may include a netting bar or elongated member 550 for operably supporting a lower edge portion 537 of netting 530 below or on top of a top portion of gate 16. For example, elongated member 550 may be a plastic rod. It will be appreciated that other suitable elongated members may be employed.

Figure 6:
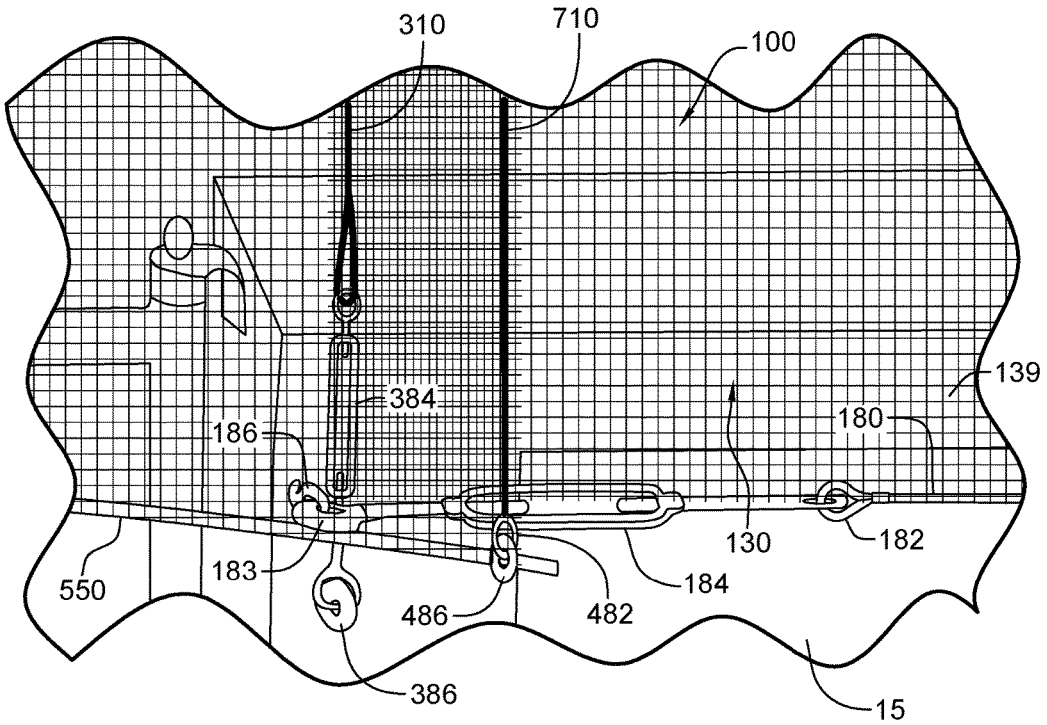
FIG. 6 is an enlarged perspective view of a lower right portion of the ball safety netting system of FIG. 5.

FIG. 6 illustrates an enlarged view of the lower right portion of the second side of gate 16 shown in FIG. 5. A lower edge portion 139 of main netting 130 of main netting system 100 may be operably attached to a lower horizontally-extending cable 180. For example, an end of cable 180 may be attached to a swaged thimble 182, which is attached to a turnbuckle 184. An end 183 of turnbuckle 184 may be attached to an eye bolt 186 operably anchored to support structure 15 such as a brick or concrete wall. In this illustrated embodiment, vertically-extending cable 310 may include a turnbuckle 384 connected to an eye bolt 386 operably anchored to support structure 15. Vertically-extending cable 710 may include a swaged thimble 482 connected to an eyebolt 486 operably anchored to support structure 15. An end portion of elongated member 550 may be position below and restrained from upward movement by a shank portion of eye bolt 486. Main netting system 100 and the other edge portion of netting system 500 may be operably secured in a similar manner as shown in FIG. 5.

Figure 8:
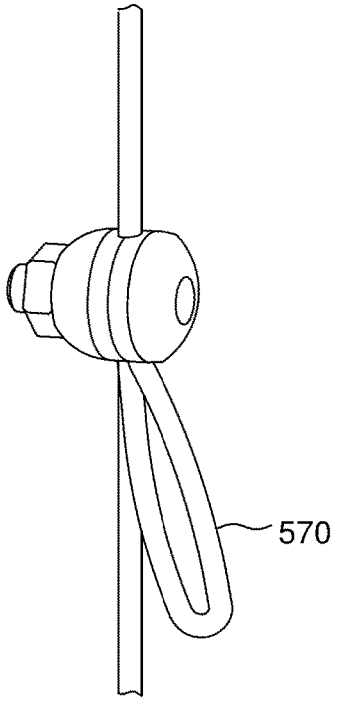
FIG. 8 is an enlarged perspective view of the connector in FIG. 7 for use maintaining the access/egress netting system disposed in the second or raised position.

As shown in FIG. 7, gate netting system 500 is positionable or suspendable in a raised position over access/egress gate 16. For example, gate netting system 500 may be disposable in a raised position to allow access and/or egress past gate 16. In this embodiment, netting 530 and elongated member 550 may be raised by field personnel and supported above gate 16. For example, the ends of elongated member 550 may be supported from cables 610 and 710 by connector loops 570. As shown in FIG. 8, the ends of the elongated member may be slid into and supported from connectors loops 570 operably attached to cable 610 (FIG. 7) and cable 710 (FIG. 7).

Figure 9:
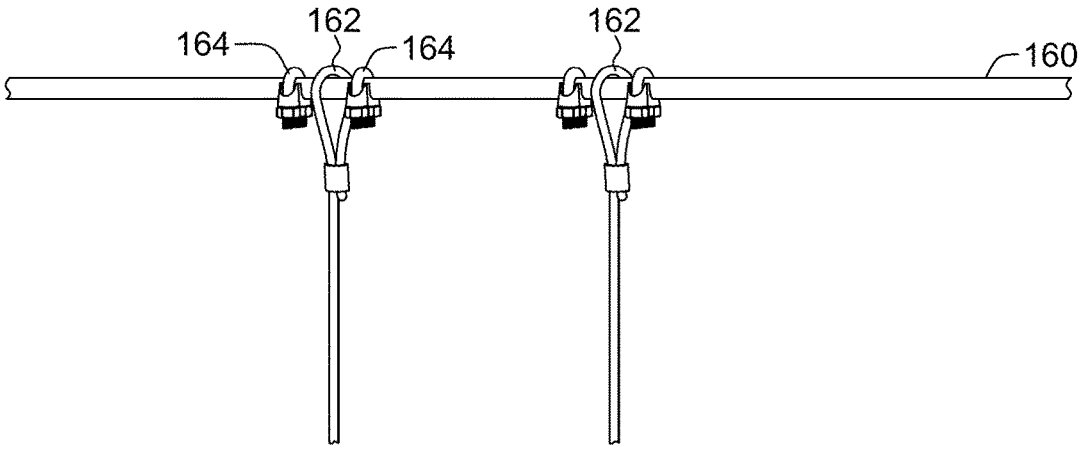
FIG. 9 is an enlarged perspective view of upper portions of the vertical cables of the ball safety netting system in FIG. 1.

With reference to FIG. 9, upper end of the vertical cables may include a swaged thimble 162 which is supported by generally horizontally-extending cable 160. A plurality of wire rope clips 164 may be operably secured to cable 160 for inhibiting horizontal movement of the vertically-extending cables.

With reference again to FIG. 1, main netting system 100 and gate netting system 500 are disposed generally in alignment between the field and the stands. In one embodiment, main netting system 100 may be disposed toward the field, and gate netting system 500 may be disposed behind main netting system 100 toward the stands. In another embodiment, a gate netting system may be disposed toward the field, and a main netting system may be disposed behind the main netting system toward the stands. Employing horizontally-extending and vertically extending cables maintains suitable tension on the netting in the covering position and minimizes the net flopping when in the raised position, e.g., when the gate is utilized.

In the lowered position, each vertical edge portion of gate netting system 500 may overlap about 4 inches to about 12 inches of a corresponding edge portion of main netting system 100. In one embodiment, each vertical edge portion of gate netting system 500 may overlap about 6 inches of a corresponding edge portion of main netting system 100. As shown in FIG. 3, it has been found that if a baseball 800 is hit into main netting 130 of main netting system 100 toward gate netting system 500 in the direction of arrow A with sufficient force toward the stands, baseball 800 will become trapped between the vertical wires and the overlapping netting. Baseball 800 will then fall vertically downwardly between the vertical wires and the overlapping netting.

The netting for the main netting system and for the gate netting system may be a square mesh netting having, for example, square openings of about 1¾ inches by about 1¾ inches. A suitable netting may be UltraCross® Multi-Strand Braided (Knotless) Dyneema® Netting available from Sportsfield Specialties, Inc. of Delhi, N.Y. York, and/or Promats Athletics of Salisbury, N.C. In other embodiments, a #36 knotted nylon netting may be employed.

Figure 10:
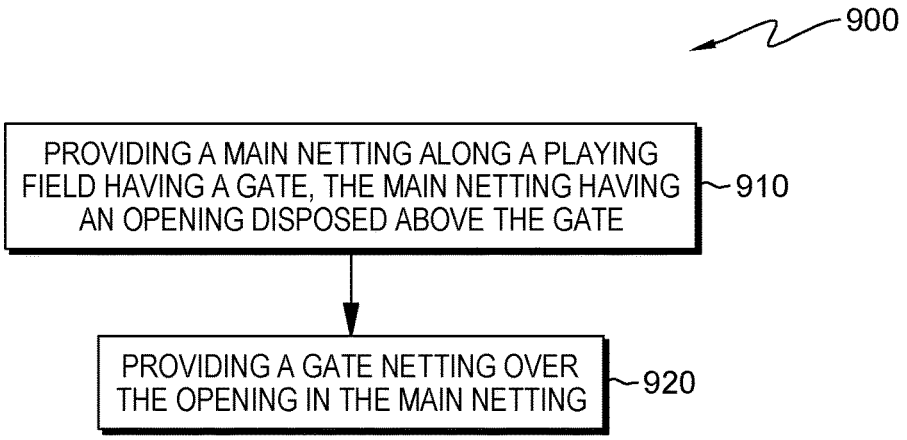
FIG. 10 is a flowchart of a method according to an embodiment of the present disclosure.

FIG. 10 is a flowchart of a method 900 according to an embodiment of the present disclosure such as for protecting spectators. Method 900 includes at 910 providing a main netting along a playing field having a gate, the main netting having an opening disposed above the gate, and at 920 providing a gate netting over the opening in the main netting.

Figure 11:
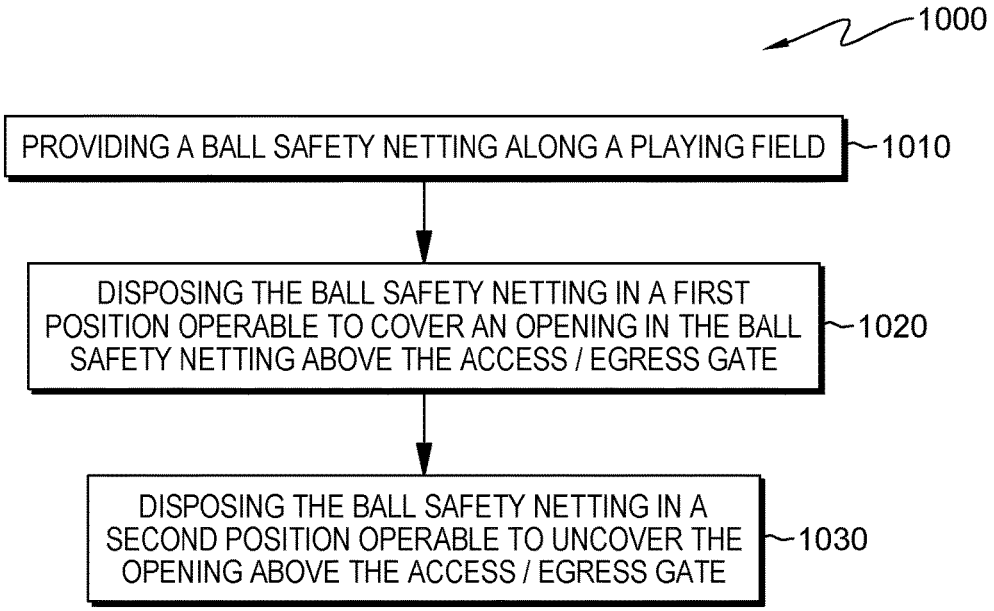
FIG. 11 is a flowchart of a method according to an embodiment of the present disclosure.

FIG. 11 is a flowchart of a method according to an embodiment of the present disclosure. Method 1000 includes at 1010 providing a ball safety netting along a playing field having an access/egress gate, at 1020 disposing the ball safety netting system in a first position operable to cover an opening in the ball safety netting above the access/egress gate, and at 1030 disposing the ball safety netting in a second position operable to uncover the opening above the access/egress gate.

In other embodiments, a ball safety netting system having a gate netting system may include lower portions of the netting systems operably secured adjacent to or directly to the ground. In other embodiments, a ball safety netting system may be operably supported from poles. Other connectors may be employed for retaining or holding the netting bar in a raised position. For example, a hooks, quick-disconnectors, strips of hook-and-loop fasteners, or other suitable connectors may be employed to retain or holding the netting bar in a raised position. In other embodiments, a spring loaded rod may be employed, which may roll up the netting as it is raised when the gate is in use. It will be appreciated that a netting bar may not be needed, for example, where the lower portion of the gate netting is operably secured to or below the gate and operably supported in an open position. In other embodiments, the lower portion of the gate netting may be operably attached to the gate in the lowered position.

The horizontally-extending and vertically-extending cables may be wire rope cables such as black vinyl coated galvanized aircraft cable or wire rope cables. The cables may be weaved through the square mesh of the netting approximately every about 12 inches to about 18 inches, and/or a plurality of zip ties may be used to attach the netting to cables. The zip ties and/or lashing twine may be fastened approximately every foot or continuously along the cable and netting. The vertical cables of the gate netting system may be woven through each square mesh of gate netting. It will be appreciated that other suitable means for attaching the netting to the vertical cables may be employed.

In other embodiments, the gate netting of the gate netting system may extend further upward toward the height of the main netting system or to the height of the main netting system, e.g., the main netting system may define a first portion and a spaced-apart second portion, which portions together define an opening therebetween over a gate.

In other embodiments, a single net or netting may be provided. For example, a main netting may extend entirely over the gate. The lower portion of the net or netting may be provided with two spaced apart vertical cuts. The lower portion of the net or netting between the vertical cuts defines a gate netting portion. The various portions of the net or netting may be operably attached to vertical cables so that lower portions of the main net or netting and portions of the gate netting portion overlap. Such a configuration may not require a separate gate netting that is attached along a horizontal edge of the main netting.

From the present description, it will be appreciated that by adding additional vertical cables extending from a horizontally-extending cable to a lower concrete structure, a "door opening" may be provided above a gate which minimally impacts visibility and which may provide a safer environment for spectators. For example, the door opening may be quickly created by releasing the lower proportion of the gate netting from the top of the gate, sliding or moving the lower portion of the gate netting upwards, then reattaching the lower portion of the gate netting above the gate in the loop rests. Once play is ready to start, the netting bar is simply released from the top loops or hooks then pulled downward and reattached below the top portion of the gate.

The present disclosure advantageously allows extending ball safety netting along a greater portion of the field and particularly over access/egress gate while not impacting field accessibility and still allowing use of the access/egress gates for entering and exiting the field and the stands. Employing vertically extending cables for supporting the main netting system and the gate netting system reduce the loss of visibility by spectators watching a game on the field compared to the use of metal structures or other structures defining a reclosable opening above the gate.

It is to be understood that the above description is intended to be illustrative, and not restrictive. For example, the above-described embodiments and/or features thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that features of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A ball safety netting system for use between a field and spectators and above an access/egress gate, said ball safety netting system comprising:

a main netting defining an opening over an access/egress gate;

a gate netting positionable over said opening of said main netting;

a vertically-extending cable disposable adjacent a first side of the access/egress gate, a vertically-extending cable disposable adjacent a second side of the access/egress gate, and the gate netting operably attached to said vertically-extending cables;

first and second upper connectors attached to said vertically-extending cables above the access/egress gate;

wherein said gate netting is disposable in a first position operable to cover said opening in said main netting above the access/egress gate, and disposable in a second position operable to uncover said opening in said main netting above the access/egress gate; and wherein said first and second upper connectors being operable to support a lower portion of said gate netting in said second position operable to uncover said opening.

2. The ball safety netting system of claim 1 wherein said gate netting overlaps a portion of said main netting when said gate netting is disposable in said first position operable to cover said opening.

3. The ball safety netting system of claim 1 further comprising an elongated member for supporting a lower edge portion of said gate netting.

4. The ball safety netting system of claim 3 wherein said first and second upper connectors are operable to support ends of said elongated member in said second position operable to uncover said opening.

5. The ball safety netting system of claim 4 wherein said first and second upper connectors comprise first and second loops, and wherein ends of the elongated member are receivable in said first and second loops.

6. The ball safety netting system of claim 1 further comprising a first lower connector disposed below an upper edge and to one side of the access/egress gate, a second lower connector disposed below an upper edge and to the other side of the access/egress gate, and said first and said second lower connectors are operable to secure lower ends of said vertically-extending cables, and a lower portion of said gate netting.

7. The ball safety netting system of claim 1 wherein a first edge portion and a second end portion of said gate netting are woven through said vertically-extending cables.

8. The ball safety netting system of claim 1 wherein said main netting and said gate netting are disposed in alignment between the field and the spectators.

9. The ball safety netting system of claim 1 wherein said main netting is disposed toward the field, and said gate netting is disposed behind said main netting toward the spectators.

10. The ball safety netting system of claim 1 wherein said gate netting is disposed toward the field, and said main netting is disposed behind said gate netting toward the spectators.

11. The ball safety netting system of claim 1 further comprising a horizontally-extending cable for supporting upper ends of said vertically-extending cables.

12. The ball safety netting system of claim 1 wherein said gate netting is operable to overlap about 4 inches to about 12 inches of said main netting.

13. The ball safety netting system of claim 1 wherein said gate netting is operable to overlap about 6 inches of said main netting.

14. The ball safety netting system of claim 1 further comprising:

a field;

a plurality of seats for spectators;

an access/egress gate between said field and said plurality of seats; and wherein said ball safety netting system is disposed between said field and said plurality of seats.

15. A ball safety netting system for use between a field and spectators and above an access/egress gate, said netting system comprising:

a main netting system having edge portions defining an opening over an access/egress gate, said main netting system comprising first vertically-extending cables each of which disposable adjacent a different one of a first side and a second side of the access/egress gate, and a main netting operably attached to one of the first vertically-extending cables and operably attached to the other of the first vertically-extending cables;

a gate netting system positionable over said opening and overlapping portions of said main netting system, said gate netting system comprising second vertically-extending cables each of which disposable adjacent a different one of the first side and the second side of the access/egress gate, and a gate netting operably attached along one edge portion to one of said second vertically-extending cables and along another edge portion to the other of said second vertically-extending cables;

a first lower connector disposed below an upper edge and to one side of the access/egress gate, a second lower connector disposed below an upper edge and to the other side of the access/egress gate;

wherein said gate netting system is disposable in a first position operable to cover said opening above the access/egress gate, and disposable in a second position operable to uncover said opening above the access/egress gate; and wherein said first and said second lower connectors are operable to secure lower ends of said second vertically-extending cables, and a lower portion of said gate netting.

16. The ball safety netting system of claim 15 wherein said gate netting system comprises an elongated member for supporting a lower edge portion of said gate netting of said gate netting system.

17. The ball safety netting system of claim 16 further comprising a first and second upper connectors attached to said second vertically-extending cables above the access/egress gate, and said first and second upper connectors being operable to support ends of said elongated member in the second position.

18. The ball safety netting system of claim 15 wherein a first vertical edge portion and a second vertical edge portion of said gate netting are woven through different ones of said second vertically-extending cables.

19. The ball safety netting system of claim 15 wherein said main netting system and said gate netting system are disposed in alignment between the field and the spectators.

20. The ball safety netting system of claim 15 wherein said main netting system is disposed toward the field, and said gate netting system is disposed behind said main netting system toward the spectators.

21. The ball safety netting system of claim 15 wherein said gate netting is disposed toward the field, and said main netting is disposed behind said gate netting toward the spectators.

22. The ball safety netting system of claim 15 further comprising a horizontally-extending cable for supporting upper ends of said vertically-extending cables.

23. The ball safety netting system of claim 15 wherein a first vertical portion of said gate netting system is operable to overlap about 4 inches to about 12 inches of a first vertical portion of said main netting system, and a second vertical portion of said gate netting system is operable to overlap about 4 inches to about 12 inches of a second vertical portion of said main netting system.

24. The ball safety netting system of claim 15 wherein a first vertical portion of said gate netting system is operable to overlap about 6 inches of a first vertical portion of said main netting system, and a second vertical portion of said gate netting system is operable to overlap about 6 inches of a second vertical portion of said main netting system.

25. The ball safety netting system of claim 15 further comprising:

a field;

a plurality of seats for spectators;

an access/egress gate between said field and said plurality of seats; and wherein said ball safety netting system is disposed between said field and said plurality of seats.

26. A ball safety netting system for use between a field and spectators and above an access/egress gate, said ball safety netting system comprising:

a main netting defining an opening over an access/egress gate;

a gate netting positionable over said opening of said main netting;

a vertically-extending cable disposable adjacent a first side of the access/egress gate, a vertically-extending cable disposable adjacent a second side of the access/ egress gate, and the gate netting operably attached to said vertically-extending cables;

a first lower connector disposed below an upper edge and to one side of the access/egress gate, a second lower connector disposed below an upper edge and to the other side of the access/egress gate, and said first and said second lower connectors are operable to secure lower ends of said vertically-extending cables, and a lower portion of said gate netting; and wherein said gate netting is disposable in a first position operable to cover said opening in said main netting above the access/egress gate, and disposable in a second position operable to uncover said opening in said main netting above the access/egress gate.

27. The ball safety netting system of claim 26 wherein said gate netting overlaps a portion of said main netting when said gate netting is disposable in said first position operable to cover said opening.

28. The ball safety netting system of claim 26 further comprising an elongated member for supporting a lower edge portion of said gate netting.

29. The ball safety netting system of claim 26 wherein said main netting and said gate netting are disposed in alignment between the field and the spectators.

30. The ball safety netting system of claim 26 wherein said gate netting is operable to overlap about 4 inches to about 12 inches of said main netting.

31. The ball safety netting system of claim 26 further comprising a horizontally-extending cable for supporting upper ends of said vertically-extending cables.

32. A ball safety netting system for use between a field and spectators and above an access/egress gate, said netting system comprising:

a main netting system having edge portions defining an opening over an access/egress gate, said main netting system comprising first vertically-extending cables each of which disposable adjacent a different one of a first side and a second side of the access/egress gate, and a main netting operably attached to one of the first vertically-extending cables and operably attached to the other of the first vertically-extending cables;

a gate netting system positionable over said opening and overlapping portions of said main netting system, said gate netting system comprising second vertically-extending cables each of which disposable adjacent a different one of the first side and the second side of the access/egress gate, and a gate netting operably attached along one edge portion to one of said second vertically-extending cables and along another edge portion to the other of said second vertically-extending cables;

a first and second upper connectors attached to said second vertically-extending cables above the access/egress gate;

wherein said gate netting system is disposable in a first position operable to cover said opening above the access/egress gate, and disposable in a second position operable to uncover said opening above the access/egress gate; and wherein said first and second upper connectors being operable to support a lower portion of said gate netting in said second position operable to uncover said opening.

33. The ball safety netting system of claim 32 wherein said gate netting system comprises an elongated member for supporting a lower edge portion of said gate netting of said gate netting system.

34. The ball safety netting system of claim 32 wherein said main netting system and said gate netting system are disposed in alignment between the field and the spectators.

35. The ball safety netting system of claim 32 wherein a first vertical portion of said gate netting system is operable to overlap about 4 inches to about 12 inches of a first vertical portion of said main netting system, and a second vertical portion of said gate netting system is operable to overlap about 4 inches to about 12 inches of a second vertical portion of said main netting system.

36. The ball safety netting system of claim 32 further comprising a horizontally-extending cable for supporting upper ends of said vertically-extending cables.

* * * * *